US008094075B2

(12) United States Patent
Cheng et al.

(10) Patent No.: US 8,094,075 B2
(45) Date of Patent: Jan. 10, 2012

(54) CIRCULAR POLARIZATION ANTENNA STRUCTURE WITH A DUAL-LAYER CERAMIC AND METHOD FOR MANUFACTURING THE SAME

(75) Inventors: Ta-Fu Cheng, Miaoli County (TW); Hui-Chieh Wang, Hsinchu County (TW); Yuan-Piao Tseng, Hsinchu (TW)

(73) Assignee: Inpaq Technology Co., Ltd., Hsnchu (TW)

( * ) Notice: Subject to any disclaimer, the term of this patent is extended or adjusted under 35 U.S.C. 154(b) by 450 days.

(21) Appl. No.: 12/345,969

(22) Filed: Dec. 30, 2008

(65) Prior Publication Data

US 2010/0164809 A1 Jul. 1, 2010

(51) Int. Cl.
*H01Q 1/38* (2006.01)

(52) U.S. Cl. ..... 343/700 MS; 343/846

(58) Field of Classification Search ..... 343/700 MS, 343/846, 848

See application file for complete search history.

(56) References Cited

U.S. PATENT DOCUMENTS

2006/0017618 A1* 1/2006 Tseng et al. ..... 343/700 MS
2009/0102723 A1* 4/2009 Mateychuk et al. ... 343/700 MS
2009/0267841 A1* 10/2009 Liao et al. ..... 343/700 MS

* cited by examiner

*Primary Examiner* — Hoanganh Le

(74) *Attorney, Agent, or Firm* — Rosenberg, Klein & Lee

(57) ABSTRACT

A circular polarization antenna structure with a dual-layer ceramic includes a first hard dielectric body, a first metal layer, a grounding layer, an antenna feed pin, a second hard dielectric body, a second metal layer and an adhesive element. The first metal layer and the grounding layer dispose on a top surface and a bottom surface of the first hard dielectric body. The antenna feed pin passes through the through hole of the first hard dielectric body, the top side of the antenna feed pin is fixed on the top surface of the first hard dielectric body, and the bottom side of the antenna feed pin extends outwards from the bottom surface of the first hard dielectric body. The second hard dielectric body disposes above the top side of the first hard dielectric body. The second metal layer disposes on the top surface of the second hard dielectric body.

18 Claims, 4 Drawing Sheets

CIRCULAR POLARIZATION ANTENNA STRUCTURE WITH A DUAL-LAYER CERAMIC AND METHOD FOR MANUFACTURING THE SAME

BACKGROUND OF THE INVENTION

1. Field of the Invention

The present invention relates to a circular polarization antenna structure and a method for manufacturing the same, and particularly relates to a circular polarization antenna structure with a dual-layer ceramic and a method for manufacturing the same.

2. Description of Related Art

Due to the development of communication technology, a lot of electronic products have been developed that use wireless communication technology, such as cell phones, wireless Internet devices, and personal digital assistants (PDAs), etc. The requirements demanded by consumers for the wireless communication devices has become higher and higher, namely in terms of the appearance and dimensions of the devices. For cell phones, the receiving frequency has developed from a single frequency, to two, then three, and now four frequencies. Consumers also prefer cell phones having the characteristics of an appealing appearance, small dimensions, light weight, and portability.

Because SDARS (Satellite Digital Audio Radio Service) can receive high quality audio signals and can be applied to many radio stations, SDARS is popular in USA. At present, the bandwidth of SDARS is serviced by two system operators (SIRIUS and XM), who share the bandwidth range to equal parts.

Moreover, SDARS mostly uses a circular polarization antenna with single-layer substrates or uses a copper foil to paste on the circular polarization antenna with single-layer substrates by foamed plastic. However, the zenith gain of the circular polarization antenna with single-layer substrates is low. In addition, the copper foil pasted on the on the circular polarization antenna by the foamed plastic is compressed easily by external force, so the conductivity of the circular polarization antenna with single-layer substrates is unstable. Furthermore, SIRIUS and XM are merged in order to provide high frequency and high zenith gain, so that a new circular polarization antenna needs to be created to achieve corresponding frequency and zenith gain.

SUMMARY OF THE INVENTION

One particular aspect of the present invention is to provide a circular polarization antenna structure with a dual-layer ceramic and a method for manufacturing the same. The circular polarization antenna structure of the present invention has the following advantages:

1. The circular polarization antenna structure with the dual-layer ceramic is applied to receive SDARS (Satellite Digital Audio Radio Service) in order to obtain good receiving effect.

2. The conductivity stability of the circular polarization antenna structure with the dual-layer ceramic is increased.

3. The circular polarization antenna structure with the dual-layer ceramic has high bandwidth, high zenith gain and good axial ration bandwidth.

In order to achieve the above-mentioned aspects, the present invention provides a circular polarization antenna structure with a dual-layer ceramic, including: a first hard dielectric body, a first metal layer, a grounding layer, an antenna feed pin, a second hard dielectric body, a second metal layer and an adhesive element. The first hard dielectric body has a through hole. The first metal layer is formed on a top surface of the first hard dielectric body. The grounding layer is formed on a bottom surface of the first hard dielectric body. The antenna feed pin passes through the through hole of the first hard dielectric body. The top side of the antenna feed pin is fixed above the first hard dielectric body and the bottom side of the antenna feed pin is extended outwards from the bottom surface of the first hard dielectric body. The second hard dielectric body is disposed above the first hard dielectric body. The second metal layer is formed on a top surface of the second hard dielectric body. The adhesive element is disposed between the first metal layer and the second hard dielectric body so that the first hard dielectric body and the second hard dielectric body are adhered to each other.

In order to achieve the above-mentioned aspects, the present invention provides a method for manufacturing a circular polarization antenna structure with a dual-layer ceramic, including: respectively forming a first metal layer and a grounding layer on a top surface and a bottom surface of a first hard dielectric body; calculating an installed position for an antenna feed pin by a simulation software in order to obtain a highest zenith gain; forming a through hole passing through the first hard dielectric body according to the installed position, the antenna feed pin passing through the through hole of the first hard dielectric body, and the antenna feed pin having a top side fixed above the first hard dielectric body and a bottom side extended outwards from the bottom surface of the first hard dielectric body; providing a second hard dielectric body and forming a second metal layer on a top surface of the second hard dielectric body, and the second hard dielectric body disposed above the first hard dielectric body; adhering the first hard dielectric body and the second hard dielectric body to each other by an adhesive element that is disposed between the first metal layer and the second hard dielectric body; and adjusting the bandwidth of the circular polarization antenna structure according to different usage requirements.

Therefore, the present invention uses two ceramic structures (the first hard dielectric body and the second hard dielectric body). In addition, the bandwidth of the present invention can be applied to SDARS due to the resonance between a top ceramic (the second hard dielectric body) and a bottom ceramic (the first hard dielectric body). The top ceramic has a single electrode face (the second metal layer) only, and the top ceramic is firmly fixed above the bottom ceramic by the adhesive element. Hence, the structure stability of the two ceramic structures is good, so that the conductivity stability of the circular polarization antenna structure with the dual-layer ceramic is good (the frequency shift phenomenon is small).

Furthermore, the resistivity of the present invention can be modified in order to achieve the resistivity matching by using a top electrode face (the first metal layer) and a bottom electrode face (the grounding layer). Hence, because the structure of the present invention is firmly fixed and the resistivity matching of the present invention is obtained easily, the circular polarization antenna structure with the dual-layer ceramic has high bandwidth, high zenith gain and good axial ration bandwidth.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objectives and advantages of the present invention will be more readily understood from the following detailed description when read in conjunction with the appended drawings, in which.

DETAILED DESCRIPTION OF PREFERRED EMBODIMENTS

Figure 1A:
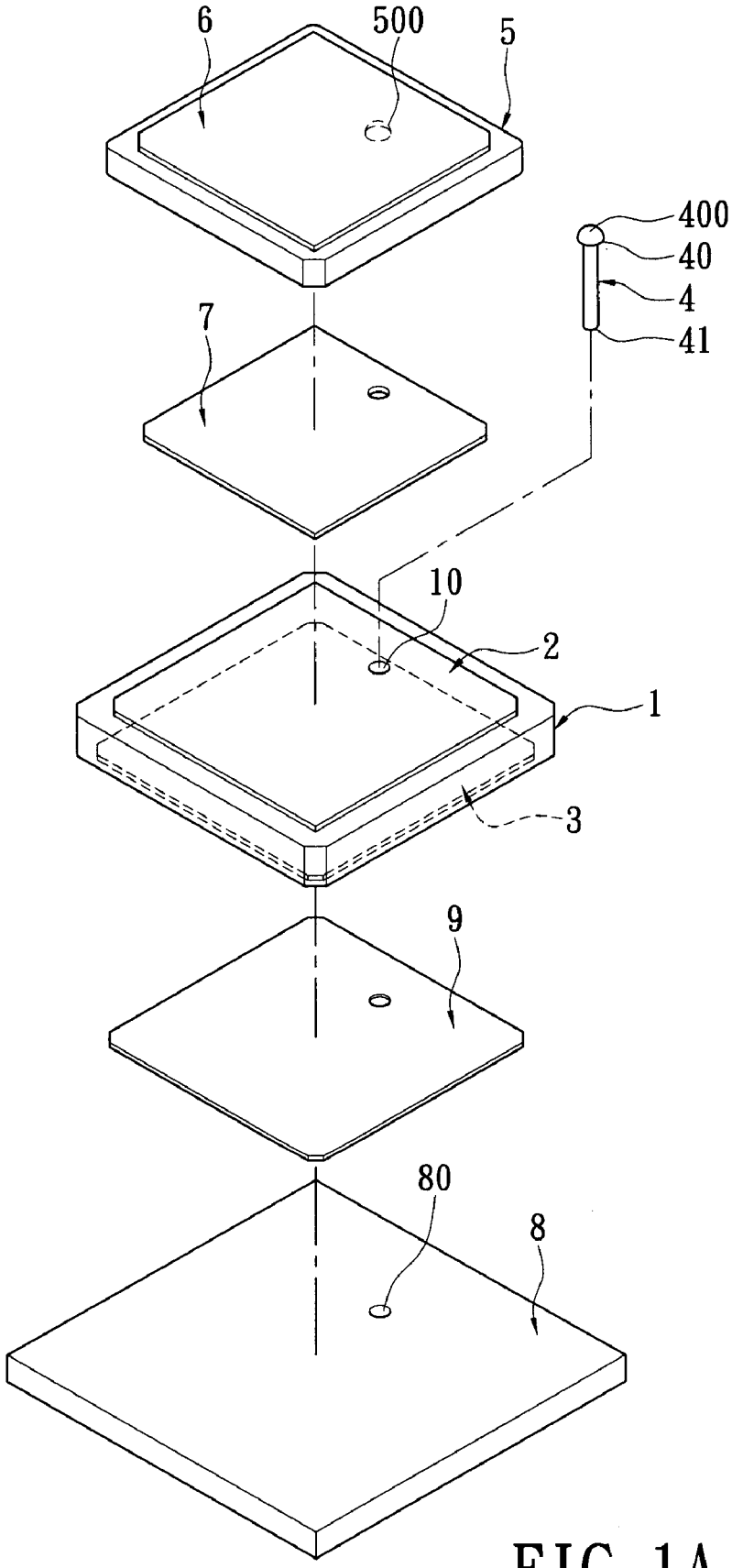
FIG. 1A is a perspective, exploded, schematic view of a circular polarization antenna structure with a dual-layer ceramic according to the present invention.
Figure 1B:
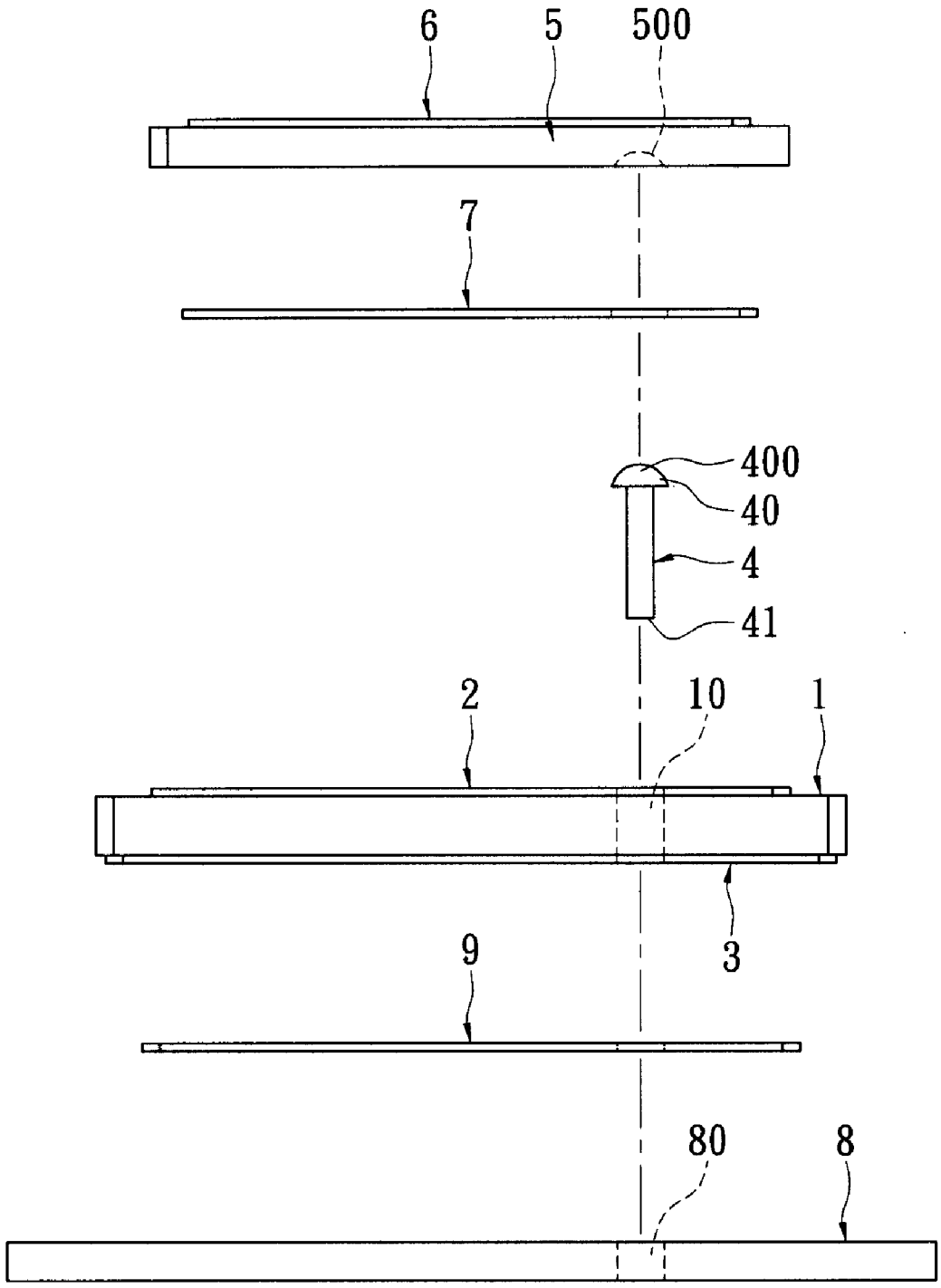
FIG. 1B is a lateral, exploded, schematic view of a circular polarization antenna structure with a dual-layer ceramic according to the present invention.
Figure 2A:
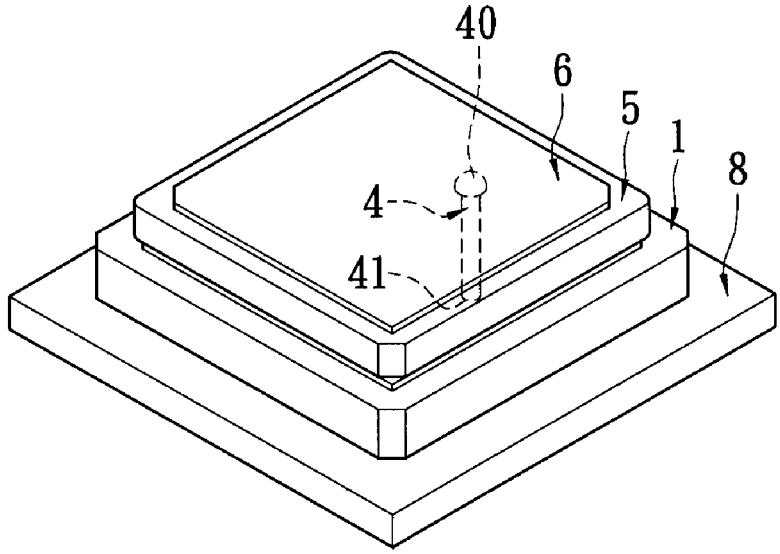
FIG. 2A is a perspective, assembled, schematic view of a circular polarization antenna structure with a dual-layer ceramic according to the present invention.
Figure 2B:
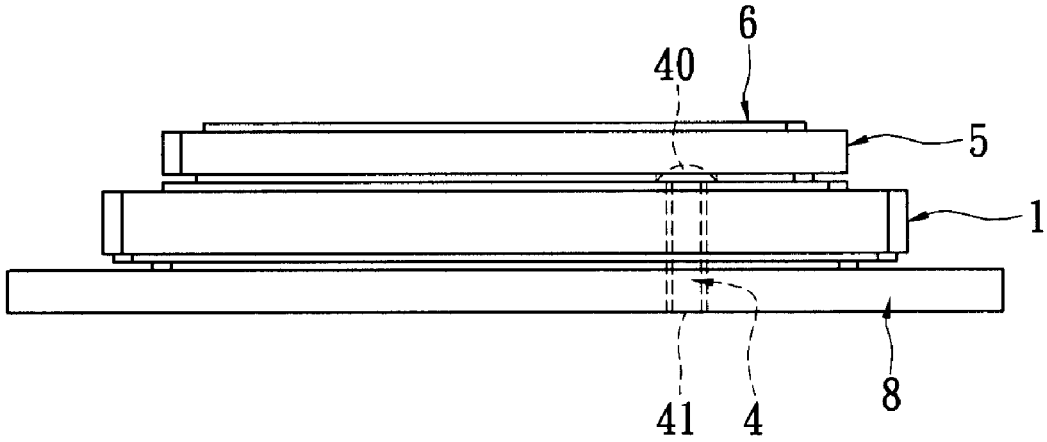
FIG. 2B is a lateral, assembled, schematic view of a circular polarization antenna structure with a dual-layer ceramic according to the present invention.

Referring to FIGS. 1A and 2B, the present invention provides a circular polarization antenna structure with a dual-layer ceramic, including: a first hard dielectric body 1, a first metal layer 2, a grounding layer 3, an antenna feed pin 4, a second hard dielectric body 5, a second metal layer 6 and an adhesive element 7.

The first hard dielectric body 1 can be made of an insulative material such as ceramic, and the first hard dielectric body 1 has a through hole 10. In addition, the first metal layer 2 is formed on a top surface of the first hard dielectric body 1, and the grounding layer 3 is formed on a bottom surface of the first hard dielectric body 1. However, the feature of the first hard dielectric body 1 being made of ceramic is just an example. Any dielectric material can be applied to the first hard dielectric body 1.

Moreover, the antenna feed pin 4 passes through the through hole 10 of the first hard dielectric body 1. The top side 40 of the antenna feed pin 4 is fixed above the first hard dielectric body 1 and the bottom side 41 of the antenna feed pin 4 is extended outwards from the bottom surface of the first hard dielectric body 1.

Furthermore, the top side 40 of the antenna feed pin 4 is electrically connected to the first metal layer 2, and the antenna feed pin 4 is insulated from the grounding layer 3. In addition, the antenna feed pin 4 has a protrusion 400 formed on its top side, and the protrusion 400 is disposed above the top surface of the first hard dielectric body 1. The second hard dielectric body 5 has a groove 500 formed on its bottom surface and corresponding to the protrusion 400. Therefore, the protrusion 400 is received in the groove 500 so that the second hard dielectric body 5 is firmly positioned above the first hard dielectric body 1 by matching the protrusion 400 and the groove 500.

In addition, the second hard dielectric body 5 can be made of an insulative material such as ceramic, and the second hard dielectric body 5 can be a solid body. Moreover, the second hard dielectric body 5 is disposed above the first hard dielectric body 1. However, the feature of the second hard dielectric body being made of ceramic is just an example. Any dielectric material can be applied to the second hard dielectric body 5.

Moreover, the second metal layer 6 is formed on a top surface of the second hard dielectric body 5. The adhesive element 7 is disposed between the first metal layer 2 and the second hard dielectric body 5 so that the first hard dielectric body 1 and the second hard dielectric body 5 are adhered to each other. In addition, the adhesive element 7 can be a twin adhesive tape or an adhesive colloid body according to different requirements. In this embodiment, the adhesive element 7 is a twin adhesive tape that has two adhesive faces respectively contacted with the first metal layer 2 and the second hard dielectric body 5.

Furthermore, the circular polarization antenna structure further includes: a printed circuit board (PCB) 8 and another adhesive element 9. The printed circuit board 8 has a PCB through hole 80, and the adhesive element 9 is disposed between the grounding layer 3 and the printed circuit board 8. The bottom side of the antenna feed pin 4 passes through the PCB through hole 80 in order to electrically connect to the PCB 8. In addition, the adhesive element 9 can be a twin adhesive tape or an adhesive colloid body according to different requirements. In this embodiment, the adhesive element 9 is a twin adhesive tape that has two adhesive faces respectively contacted with the grounding layer 3 and the printed circuit board 8.

Figure 3:
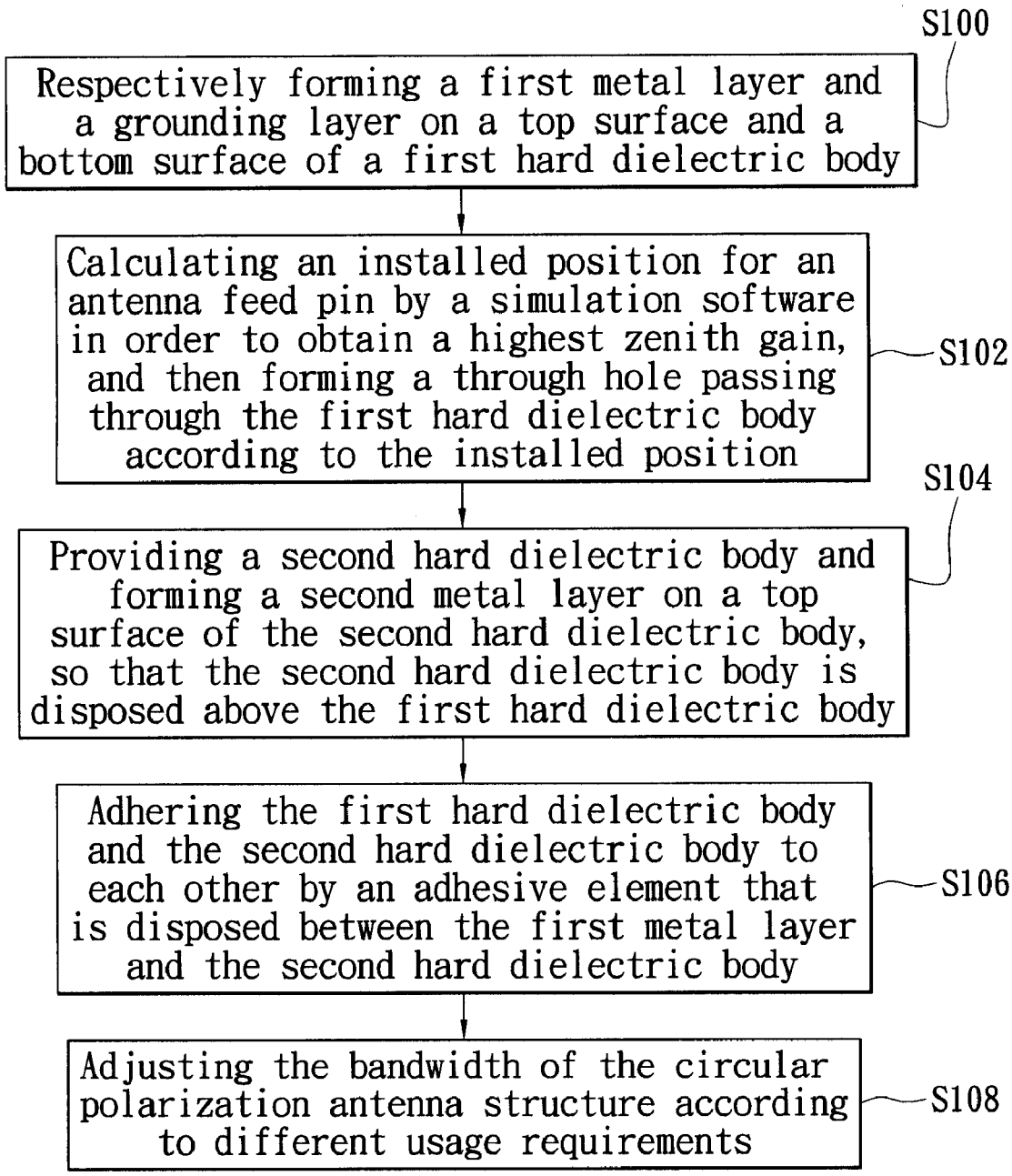
FIG. 3 is a flowchart of a method for manufacturing a circular polarization antenna structure with a dual-layer ceramic according to the present invention.

Referring to FIG. 3, the present invention provides a method for manufacturing a circular polarization antenna structure with a dual-layer ceramic, including:

Step S100 is that: respectively forming a first metal layer 2 and a grounding layer 3 on a top surface and a bottom surface of a first hard dielectric body 1.

Step S102 is that: calculating an installed position for an antenna feed pin 4 by a simulation software in order to obtain a highest zenith gain, and then forming a through hole 10 passing through the first hard dielectric body 1 according to the installed position. The antenna feed pin 4 passes through the through hole 10 of the first hard dielectric body 1, and the antenna feed pin 4 has a top side 40 fixed above the first hard dielectric body 1 and a bottom side 41 extended outwards from the bottom surface of the first hard dielectric body 1.

Step S104 is that: providing a second hard dielectric body 5 and forming a second metal layer 6 on a top surface of the second hard dielectric body 5, so that the second hard dielectric body 5 is disposed above the first hard dielectric body 1.

Step S106 is that: adhering the first hard dielectric body 1 and the second hard dielectric body 5 to each other by an adhesive element 7 that is disposed between the first metal layer 2 and the second hard dielectric body 5.

Step S108 is that: adjusting the bandwidth of the circular polarization antenna structure according to different usage requirements.

In conclusion, the present invention uses two ceramic structures (the first hard dielectric body 1 and the second hard dielectric body 5). In addition, the bandwidth of the present invention can be applied to SDARS due to the resonance between a top ceramic (the second hard dielectric body 5) and a bottom ceramic (the first hard dielectric body 1). The top ceramic has a single electrode face (the second metal layer 6) only, and the top ceramic is firmly fixed above the bottom ceramic by the adhesive element 7. Hence, the structure stability of the two ceramic structures is good, so that the conductivity stability of the circular polarization antenna structure with the dual-layer ceramic is good (the frequency shift phenomenon is small).

Furthermore, the resistivity of the present invention can be modified in order to achieve the resistivity matching by using a top electrode face (the first metal layer 2) and a bottom electrode face (the grounding layer 3). Hence, because the structure of the present invention is firmly fixed and the resistivity matching of the present invention is obtained easily, the circular polarization antenna structure with the dual-layer ceramic has high bandwidth, high zenith gain and good axial ration bandwidth. For example, the following table shows the comparison between the prior art and the present invention:

| | Bandwidth | Axial Ration ≦3 dB Bandwidth | Zenith Gain |
|---|---|---|---|
| circular polarization antenna structure with a single-layer ceramic | 129.45 MHz | 32 MHz | >5.3 |
| circular polarization antenna structure with a dual-layer ceramic | 163.39 MHz | 35 MHz | >5.4 |

Although the present invention has been described with reference to the preferred best molds thereof, it will be understood that the present invention is not limited to the details thereof. Various substitutions and modifications have been suggested in the foregoing description, and others will occur to those of ordinary skill in the art. Therefore, all such substitutions and modifications are intended to be embraced within the scope of the present invention as defined in the appended claims.

What is claimed is:

1. A circular polarization antenna structure with a dual-layer ceramic, comprising:

a first hard dielectric body having a through hole;

a first metal layer formed on a top surface of the first hard dielectric body;

a grounding layer formed on a bottom surface of the first hard dielectric body;

an antenna feed pin passing through the through hole of the first hard dielectric body, wherein a top side of the antenna feed pin is fixed above the first hard dielectric body and a bottom side of the antenna feed pin is extended outwards from the bottom surface of the first hard dielectric body, wherein the antenna feed pin has a protrusion formed on its top side;

a second hard dielectric body disposed above the first hard dielectric body, wherein the second hard dielectric body has a groove formed on its bottom surface and corresponding to the protrusion, and the protrusion is received in the groove so that the second hard dielectric body is firmly positioned above the first hard dielectric body by matching the protrusion and the groove;

a second metal layer formed on a top surface of the second hard dielectric body; and an adhesive element disposed between the first metal layer and the second hard dielectric body so that the first hard dielectric body and the second hard dielectric body are adhered to each other.

2. The circular polarization antenna structure as claimed in claim 1, wherein the first hard dielectric body and the second hard dielectric body are made of an insulative material.

3. The circular polarization antenna structure as claimed in claim 1, wherein the top side of the antenna feed pin is electrically connected to the first metal layer.

4. The circular polarization antenna structure as claimed in claim 1, wherein the protrusion is disposed above the top surface of the first hard dielectric body.

5. The circular polarization antenna structure as claimed in claim 1, wherein the antenna feed pin is insulated from the grounding layer.

6. The circular polarization antenna structure as claimed in claim 1, wherein the second hard dielectric body is a solid body.

7. The circular polarization antenna structure as claimed in claim 1, wherein the adhesive element is a twin adhesive tape.

8. The circular polarization antenna structure as claimed in claim 1, wherein the adhesive element is an adhesive colloid body.

9. The circular polarization antenna structure as claimed in claim 1, further comprising: a printed circuit board having a PCB through hole, wherein the bottom side of the antenna feed pin passes through the PCB through hole in order to electrically connect to the PCB.

10. The circular polarization antenna structure as claimed in claim 9, further comprising: another adhesive element disposed between the grounding layer and the PCB.

11. The circular polarization antenna structure as claimed in claim 10, wherein the another adhesive element is a twin adhesive tape.

12. The circular polarization antenna structure as claimed in claim 10, wherein the another adhesive element is an adhesive colloid body.

13. A method for manufacturing a circular polarization antenna structure with a dual-layer ceramic, comprising:

respectively forming a first metal layer and a grounding layer on a top surface and a bottom surface of a first hard dielectric body;

calculating an installed position for an antenna feed pin by a simulation software in order to obtain a highest zenith gain, wherein the antenna feed pin has a protrusion formed on its top side;

forming a through hole passing through the first hard dielectric body according to the installed position, wherein the antenna feed pin passes through the through hole of the first hard dielectric body, and the antenna feed pin has a top side fixed above the first hard dielectric body and a bottom side extended outwards from the bottom surface of the first hard dielectric body;

providing a second hard dielectric body and forming a second metal layer on a top surface of the second hard dielectric body, wherein the second hard dielectric body is disposed above the first hard dielectric body, the second hard dielectric body has a groove formed on its bottom surface and corresponding to the protrusion, and the protrusion is received in the groove so that the second hard dielectric body is firmly positioned above the first hard dielectric body by matching the protrusion and the groove;

adhering the first hard dielectric body and the second hard dielectric body to each other by an adhesive element that is disposed between the first metal layer and the second hard dielectric body; and adjusting the bandwidth of the circular polarization antenna structure according to different usage requirements.

14. The method as claimed in claim 13, wherein the first hard dielectric body and the second hard dielectric body are made of an insulative material.

15. The method as claimed in claim 13, wherein the top side of the antenna feed pin is electrically connected to the first metal layer.

16. The method as claimed in claim 13, wherein the protrusion is disposed above the top surface of the first hard dielectric body.

17. The method as claimed in claim 13, wherein the antenna feed pin is insulated from the grounding layer.

18. The method as claimed in claim 13, wherein the second hard dielectric body is a solid body.

* * * * *